US011437727B2

(12) United States Patent
Boin

(10) Patent No.: US 11,437,727 B2
(45) Date of Patent: Sep. 6, 2022

(54) HORN FOR KA DUAL-BAND CIRCULARLY POLARIZED SATELLITE ANTENNA

(71) Applicant: THALES, Courbevoie (FR)

(72) Inventor: Bertrand Boin, Gennevilliers (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/131,535

(22) Filed: Dec. 22, 2020

(65) Prior Publication Data

US 2021/0203076 A1 Jul. 1, 2021

(30) Foreign Application Priority Data

Dec. 26, 2019 (FR) ..... 1915417

(51) Int. Cl.
*H01Q 13/02* (2006.01)

(52) U.S. Cl.
CPC ..... *H01Q 13/0275* (2013.01); *H01Q 13/025* (2013.01); *H01Q 13/0216* (2013.01); *H01Q 13/0225* (2013.01); *H01Q 13/0241* (2013.01); *H01Q 13/0258* (2013.01)

(58) Field of Classification Search
CPC ..... H01Q 13/0275; H01Q 21/064
See application file for complete search history.

(56) References Cited

U.S. PATENT DOCUMENTS 3,458,862 A * 7/1969 Franks ..... H01Q 13/0275 343/786
3,714,652 A * 1/1973 Grabowski ..... H01Q 13/025 343/756
6,323,819 B1 * 11/2001 Ergene ..... H01Q 13/0241 343/786
6,507,323 B1 * 1/2003 West ..... H01Q 13/0241 343/786
6,650,291 B1 * 11/2003 West ..... H01Q 3/46 342/371

(Continued)

FOREIGN PATENT DOCUMENTS

EP 2 879 236 A1 6/2015
EP 3 179 634 A1 6/2017
WO 2014/05691 A1 1/2014

OTHER PUBLICATIONS

Hoefer, et al., "Analytical Expressions for the Parameters of Finned and Ridged Waveguides", 1982 IEEE MTT-S International Microwave Symposium Digest, pp. 311-313, 1982.

(Continued)

*Primary Examiner* — Ab Salam Alkassim, Jr.
(74) *Attorney, Agent, or Firm* — BakerHostetler

(57) ABSTRACT

An antenna horn includes a waveguide having an open end and an end allowing access to transmitted signals, the widest opposite walls constituting a first pair of walls, two first ridges inside the waveguide, in the middle and over the whole length of the walls of the first pair of walls, a flat central wall connecting the walls of the second pair of walls at their midpoints at the level of the accesses, stopping in the direction of the open end so as to polarize signals transmitted by the two accesses according to orthogonal circular polarizations, and forming two ridges in the middle of the walls of the second pair of walls from the side of the open end, and with an antenna, an item of radio communication equipment and a method using the horn.

12 Claims, 7 Drawing Sheets

(56) References Cited

U.S. PATENT DOCUMENTS 7,642,979 B2 * 1/2010 Hook ..... H01Q 13/0241 343/771
7,688,268 B1 * 3/2010 West ..... H01Q 13/0275 343/776
9,640,847 B2 * 5/2017 Jensen ..... H01P 1/172
9,972,897 B1 * 5/2018 Rao ..... H01Q 21/064
9,991,607 B1 * 6/2018 West ..... H01Q 13/0225
11,031,692 B1 * 6/2021 Hu ..... H01Q 5/25
11,309,637 B2 * 4/2022 Menargues Gomez ..... H01Q 21/005
2002/0011964 A1 * 1/2002 Yuanzhu ..... H01P 1/172 343/786
2002/0080081 A1 * 6/2002 Liu ..... H01Q 13/0275 343/786
2009/0079649 A1 * 3/2009 Steghafner ..... H01Q 13/0275 343/786
2010/0033391 A1 * 2/2010 McLean ..... H01Q 13/085 343/786
2011/0050527 A1 * 3/2011 Anderson ..... H01Q 13/02 343/786
2012/0218160 A1 * 8/2012 Montgomery ..... H01Q 19/025 343/776
2015/0162668 A1 * 6/2015 Oppenlaender ..... H01Q 15/24 343/776
2017/0264011 A1 * 9/2017 Kim ..... H01Q 13/0275
2019/0058260 A1 * 2/2019 Kirino ..... H01Q 21/064
2021/0036419 A1 * 2/2021 Shamblin ..... H01Q 13/0225
2021/0305708 A1 * 9/2021 Hu ..... H01Q 13/025
2022/0029257 A1 * 1/2022 Menargues Gomez ..... H01P 1/173

OTHER PUBLICATIONS

Tianang, et al., "Wide bandwidth cavity-backed dual-polarized vivaldi array antenna", 2017 IEEE International Symposium on Antennas and Propagation & USNC/URSI National Radio Science Meeting, pp. 1311-1312, Jul. 9, 2017.

* cited by examiner

HORN FOR KA DUAL-BAND CIRCULARLY POLARIZED SATELLITE ANTENNA

CROSS-REFERENCE TO RELATED APPLICATIONS

This application claims priority to foreign French patent application No. FR 1915417, filed on Dec. 26, 2019, the disclosure of which is incorporated by reference in its entirety.

FIELD OF THE INVENTION

The invention is set in the field of antenna devices and is concerned more particularly with an antenna horn for radio communications, in particular satellite radio communications in the Ka band.

In the field of satellite communications, polarization diversity is frequently used to improve spectral efficiency. Polarization diversity involves transmitting two orthogonally polarized signals in the same frequency band, or in frequency bands that overlap. This allows two signals to be transmitted simultaneously, two signals to be received simultaneously, or two signals to be transmitted and received simultaneously, for example.

BACKGROUND

Satellite communications are generally performed using circularly polarized signals, having both a vertically polarized component and a horizontally polarized component.

In the particular instance of the electromagnetic band Ka, two distinct frequency bands are involved in satellite communications:

the transmission subband 27.5-31 GHz, and the reception subband 17.3-21.2 GHz.

The antennas can be aligned with the satellite mechanically by orienting a passive antenna (for example of parabolic type) or electronically by using active beam scanning antennas. Electronic scanning antennas are antennas made up of a large number of networked elementary antennas. By adjusting the amplitude and the phase of the signals transmitted by each elementary antenna, the direction of the radiating pattern of the scanning antenna can be adjusted. These antennas are more reliable, less bulky, faster and more precise than antennas mounted on mechanical alignment elements.

Elementary antennas are arranged in a mesh, the pitch size of which affects the performance of the antenna, in particular its misalignment. The misalignment abilities of the satellite antenna increase when the size of the mesh pitch decreases. The performance expected of current electronic scanning antennas requires mesh pitches equal to or less than $\lambda/2$, where $\lambda$ is the wavelength associated with the transmission frequency of the satellite signals. In Ka band, $\lambda/2$ is 4.84 mm at the frequency of 31 GHz, which is the highest frequency in the Ka band, and therefore the sizing frequency.

An elementary antenna for satellite transmissions is generally made up of two waveguides allowing the signals to be routed to/from an item of radio communication equipment, of a polarizer configured to polarize the signals according to orthogonal circular polarizations, and of an antenna horn by means of which the signals are transmitted/received. The antenna horn is generally flared so as to perform the matching between the propagation medium in the elementary antenna and propagation in free space.

The prior art discloses elementary antennas such as the one described in the patent application EP 2.879.236. This antenna is made up of a horn having two parts, one part for transmission and one part for reception, which are connected to a polarizer in order to polarize the electromagnetic waves circularly. A dielectric is inserted into the elements in order to reduce their electrical dimension in relation to the wavelength, which allows the size of the elementary antenna to be reduced. However, this antenna does not allow transmission and reception to be performed simultaneously. Moreover, the signals are polarized outside the antenna horn (upstream of the horn when the antenna element is considered in the transmission direction), which is less than optimum in terms of compactness and weight. Finally, the use of a dielectric in order to reduce the dimensions of the antenna poses problems in regard to design and reliability (detailed below).

The prior art also discloses elementary antennas such as the one described in the international patent application WO 2014/05691 A1. This elementary antenna comprises a horn formed from a ridged square waveguide (ridged waveguide). The use of ridged waveguides allows their electrical dimension to be reduced in relation to the wavelength, in proportions higher than those obtained by using dielectrics. The antenna horn is adapted for the simultaneous transmission of two orthogonally polarized signals, but the signals are polarized outside the horn, which is less than optimum in terms of compactness and weight. Moreover, the flared shape and the dimensions of the horn of the device described in the international patent application prevent an electronic scanning antenna with a network pitch less than or equal to half of one wavelength from being implemented.

Finally, the prior art discloses antenna horns that simultaneously polarize the signal and radiate it in reduced dimensions. Such a horn 100 is shown in FIG. 1*a*. It comprises a waveguide 101 extending along a longitudinal axis zz'. FIG. 1*a* shows the horn from the rear, or from the access to the signals, which is opposite the radiating side. The waveguide 101 is of square or rectangular section. It is divided in two by a metal wall 102 so as to form two accesses 103 and 104, each access being used to inject one signal from the two signals to be transmitted. The accesses 103 and 104 are each adapted for the propagation of electromagnetic waves according to the fundamental mode TE10 in the frequency band under consideration. The fundamental mode TE10 corresponds to a mode of propagation of electromagnetic waves in a waveguide in which the electric field is linear and oriented perpendicularly in relation to the large side of the waveguide. By positioning a rectangular waveguide horizontally, the TE10 mode therefore corresponds to a vertically polarized signal, contrary to the fundamental mode TE01, which itself corresponds to a mode of propagation of electromagnetic waves in a waveguide in which the electric field is linear and oriented horizontally in relation to the large side of the waveguide. In practice, to ensure that the waveguide is adapted for propagation according to the TE10 mode, its largest side needs to be of greater dimensions than the minimum guided wavelength in the frequency band under consideration.

The width of the metal wall 102 separating the two waveguides 103 and 104 is interrupted in the direction of the radiating side of the antenna along the axis zz', and has a dentiform structure, so as to implement a septum polarizer. A septum polarizer, which is well known to persons skilled in the art, allows a signal to be circularly polarized by adding a delayed orthogonal component thereto. It is designed so that the orthogonal component is 90° out of phase and delayed by one quarter of a wavelength, the effect of which is to polarize each of the signals transmitted in the accesses 103 and 104 circularly and in orthogonal fashion. The horn 100 described in FIG. 1*a* therefore acts as both a radiating element and a septum polarizer.

To reduce the dimensions of the horn 100, the two accesses of the horn are filled with dielectric. FIG. 1*b* shows an exploded view of the various elements of the horn from FIG. 1*a*. It depicts:

a metal waveguide 101, which features a metal wall 102 configured to form two waveguides 103 and 104 and to circularly polarize the two transmitted signals, two dielectric materials 113 and 114 configured to fill the cavities of the metal waveguide 101. It can be seen in particular that the dielectric 114 fits the shape of the metal wall 102 to fill the waveguide 101, a dielectric material 115, which is positioned in front of the head of the waveguide 101 in order to perform the matching allowing the propagation of electromagnetic waves between the antenna horn 101 and the free space. This dielectric material allows the use of a metal waveguide 101 of reduced dimensions rather than a flared horn, and therefore a gain in compactness and opportunities for integration into a network of elementary antennas having a mesh of reduced pitch size.

If the solution presented in FIG. 1*a* has the advantage of being able to be integrated into a mesh of pitch size less than or equal to $\lambda/2$, the use of substrates in the form of dielectric materials makes producing the antenna horn complex because the substrates and the metal horn need to be manufactured separately and then assembled with a high level of precision. The slightest defect in assembling the dielectric materials and the metal parts, in particular when mechanically adjusting the dielectric elements 113 and 114 in the waveguide 101, has great consequences for the performance of the elementary antenna element. It is also difficult to guarantee the constancy of the properties of a dielectric material over time and under variable temperature conditions. For this reason, the device in FIG. 1*a* proves tricky to manufacture, and is therefore very costly. The problem is all the greater because scanning antennas can have a very large number of elementary antennas (as many as several thousand), which results in long assembly times and high costs. Moreover, the inhomogeneous performance of elementary elements has an impact on the general performance of the scanning antenna.

Finally, the size of the antenna horn shown in FIG. 1*a* is directly linked to the electrical permittivity properties of the dielectric component used. Further reducing the size of the horn requires the design of a new dielectric material of higher permittivity, an operation which is complex and itself also costly. Furthermore, when the permittivity of a dielectric material increases, losses also increase. The gain of the antenna, and therefore the link budget and the proposed bit rates, then decrease proportionally.

SUMMARY OF THE INVENTION

It is therefore an object of the invention to describe an antenna horn allowing the transmission of two signals according to orthogonal circular polarizations in Ka band that is compatible with integration into a network antenna having a mesh of reduced dimensions (typically less than or equal to $\lambda/2$) and the design of which is simplified compared with the antenna from FIG. 1*a*. The antenna horn must be able to meet the needs of a wider and wider passband and of an increase in the frequencies used for transmissions.

To this end, the present invention describes an antenna horn, in particular for satellite communications, comprising a waveguide extending along a longitudinal axis. The waveguide has an open end and an end allowing access to signals transmitted in the waveguide. The widest opposite walls of the waveguide constitute a first pair of walls of the waveguide and the other two walls of the waveguide constitute a second pair of walls of the waveguide.

The antenna horn according to the invention moreover comprises:

two first ridges extending along the longitudinal axis inside the waveguide, in the middle and over the whole length of each of the walls of the first pair of walls, a flat central wall extending in the waveguide along the longitudinal axis, the central wall being configured so as:

- at the level of the end allowing access to the signals transmitted in the waveguide, to connect the two walls of the second pair of walls at their midpoints, thus forming two separate accesses to said signals,
- to stop in the direction of the open end of the waveguide so as to polarize signals transmitted by the two accesses according to orthogonal circular polarizations,
- from the open end of the waveguide, forming two second ridges extending along the longitudinal axis in the middle of each of the walls of the second pair of walls.

According to one embodiment, the waveguide has a square section, either two opposite walls of the waveguide constituting the first pair of walls and the other two opposite walls of the waveguide forming the second pair of walls.

According to one embodiment, the waveguide, the first pair of ridges and the second pair of ridges have dimensions adapted for the propagation of electromagnetic waves according to the modes of propagation TE10 and TE01 in the frequency band of the transmitted signals, and wherein the two accesses have dimensions adapted for the propagation of electromagnetic waves according to the mode of propagation TE10.

According to one embodiment, the antenna horn according to the invention moreover comprises a layer of dielectric material positioned so as to cover the open end of the waveguide and configured to perform the matching between propagation inside the waveguide and propagation in free space.

According to an alternative embodiment, the first and second ridges extend outside the waveguide through its open end while having a flared shape outside the waveguide.

Advantageously, the two first ridges have identical heights and widths and wherein the two second ridges have identical heights and widths.

In one embodiment of the invention, which is adapted for satellite communications, one of the accesses of the antenna horn that are formed by the central wall and the waveguide is used to inject a first signal at a first frequency. The other access of the antenna horn is used to extract a signal at a second frequency, which is different from the first frequency. The first frequency and the second frequency are chosen as belonging to the Ka band of the electromagnetic spectrum.

Advantageously, the antenna horn according to the invention has a waveguide in which the sides of the section have a size less than or equal to $\lambda/2$, where $\lambda$ is the wavelength of the signals to be transmitted.

The invention is also concerned with an antenna comprising at least one antenna horn according to the invention.

In one embodiment of the invention, the antenna comprises a network of at least two antenna horns according to the invention, which are arranged in a mesh of regular pitch, wherein the first and second ridges extend outside the waveguides through their open ends while having a flared shape. The adjacent antenna horns are then connected by the end of one of their ridges outside the waveguides.

Finally, the invention is concerned with an item of radio communication equipment comprising an antenna of the invention, and with a telecommunication method, in particular satellite telecommunication method, between two stations, comprising the use of an item of radio communication equipment according to the invention.

BRIEF DESCRIPTION OF THE DRAWINGS

The invention will be better understood, and other features, details and advantages will become more apparent, on reading the description that follows, which is provided without limitation, and by virtue of the appended figures that follow, which are provided by way of example.

Identical references are used in various figures when the denoted elements are identical.

DETAILED DESCRIPTION

Figure 1A:
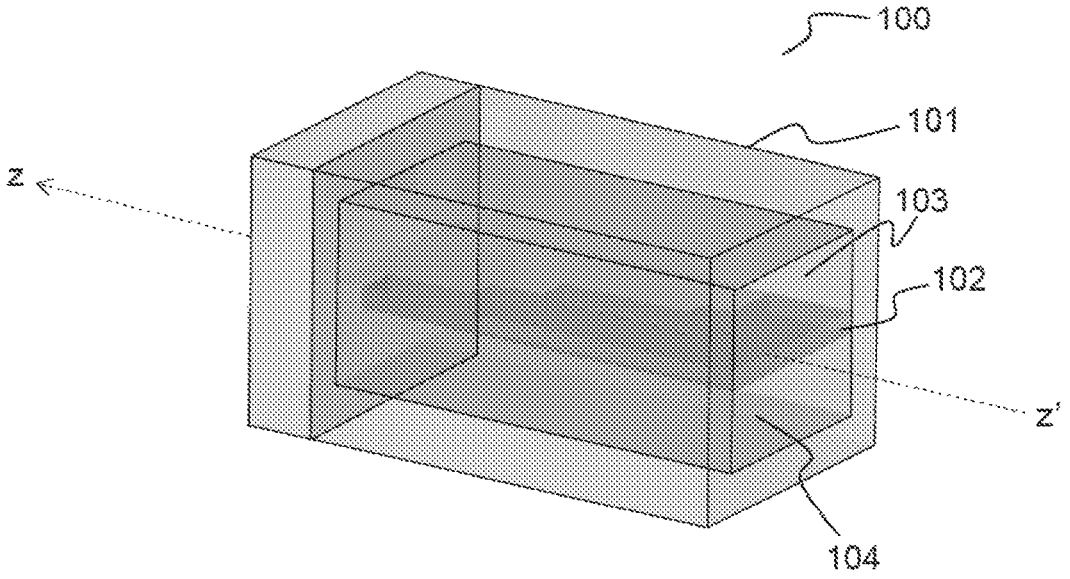
FIG.1a Prior Art
FIG. 1*a* shows an antenna horn based on the prior art that simultaneously polarizes the signal and radiates it in a mesh of reduced dimensions.
Figure 1B:
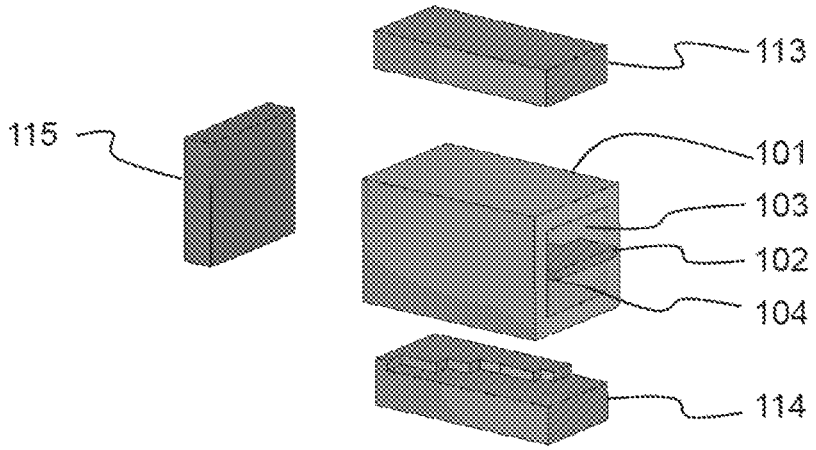
FIG.1b Prior Art
FIG. 1*b* shows an exploded view of the various elements from FIG. 1*a*.
Figure 2A:
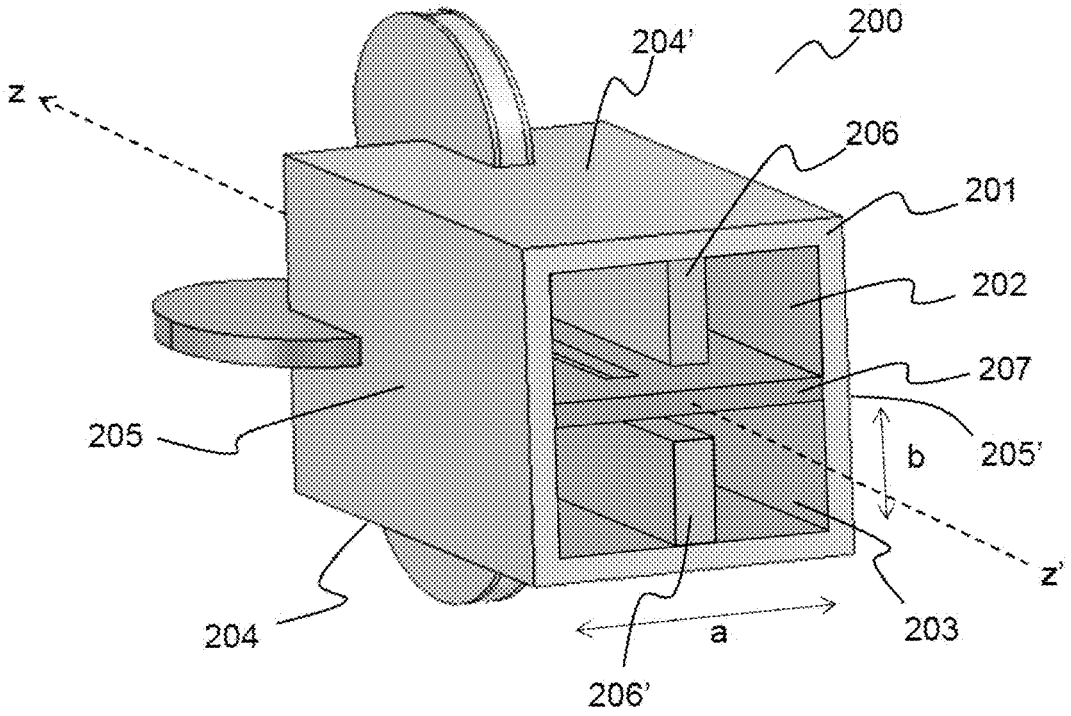
FIG. 2*a* shows an antenna horn according to a first embodiment of the invention, in a three-quarter rear view.

FIG. 2*a* shows an antenna horn according to a first embodiment of the invention, in a three-quarter rear view.

The antenna horn 200 according to the invention comprises a waveguide 201, of rectangular section, which extends along a longitudinal axis zz'. The waveguide 201 is open through an end at the front, which is the end through which the horn radiates. The other end of the waveguide 201 has accesses 202 and 203 through which the signals transmitted by the horn are injected/extracted.

The two widest opposite walls 204 and 204' of the waveguide constitute a first pair of walls. The other two opposite walls 205 and 205' constitute a second pair of walls. When the waveguide has a square section, which is a characteristic rectangle, the first pair of walls may be constituted by the opposite walls 204 and 204' or the opposite walls 205 and 205' equally.

The antenna horn according to the invention comprises two ridges 206 and 206', which are situated inside the waveguide and form a protuberance in the middle and over the whole length of each of the walls of the first pair of walls 204 and 204'. The two ridges 206 and 206' are of identical width and height.

Finally, the antenna horn according to the invention comprises a flat central wall that extends along the longitudinal axis zz'. From the accesses, the central wall 207 connects the middles of the walls of the second pair of walls 205 and 205'. It also forms two independent accesses 202 and 203 with the waveguide 201. These accesses each form a waveguide of rectangular section, of width a and of height b.

As a result of the ridges 206 and 206', each of the accesses 202 and 203 forms a ridged waveguide whose electrical dimension is reduced in relation to the wavelength, which makes the antenna horn compact. The choice in particular of the width a, of the height and of the width of the ridges 206 and 206' determines the propagation of electromagnetic waves in the waveguides 202 and 203, according to rules that are known to persons skilled in the art, as described for example in the article W. J. R. Hoefer and M. N. Burton, "Analytical Expressions for the Parameters of Finned and Ridged Waveguides," 1982 *IEEE MTT-S International Microwave Symposium Digest*, Dallas, Tex., USA, 1982, pp. 311-313.

The dimensions of the accesses 202 and 203 are chosen to allow the propagation of electromagnetic waves according to the fundamental mode of propagation TE10 in the frequency band of interest. Advantageously, in the case of an antenna for a satellite link, the frequency band of interest is the Ka band. In particular, the accesses may be adapted for propagation in the frequency band 17.3-31 GHz, which covers the transmission and reception bands for satellite transmissions in Ka band. In a particular instance of application, one of the accesses can be used to inject a signal to be transmitted into the horn and the other access can be used to recover a signal received by the horn, the two signals being transmitted at the same frequency or at different frequencies in the same frequency band.

The ridged waveguides involve no additional losses compared with conventional waveguides. The format of the waveguide 201 is directly linked to the format of the two accesses 202 and 203, as the distance between its walls 205 and 205' is equal to the width a of the accesses 202 and 203. The internal height of the waveguide 201 is twice the height b of the waveguides 202 and 203, plus the thickness of the central wall 207. This wall will therefore advantageously be chosen to be small in view of b. Typically, commercial waveguides have a ratio of height b to width a of ½, but the antenna horn according to the invention can be implemented whatever the ratio a/b.

Figure 2B:
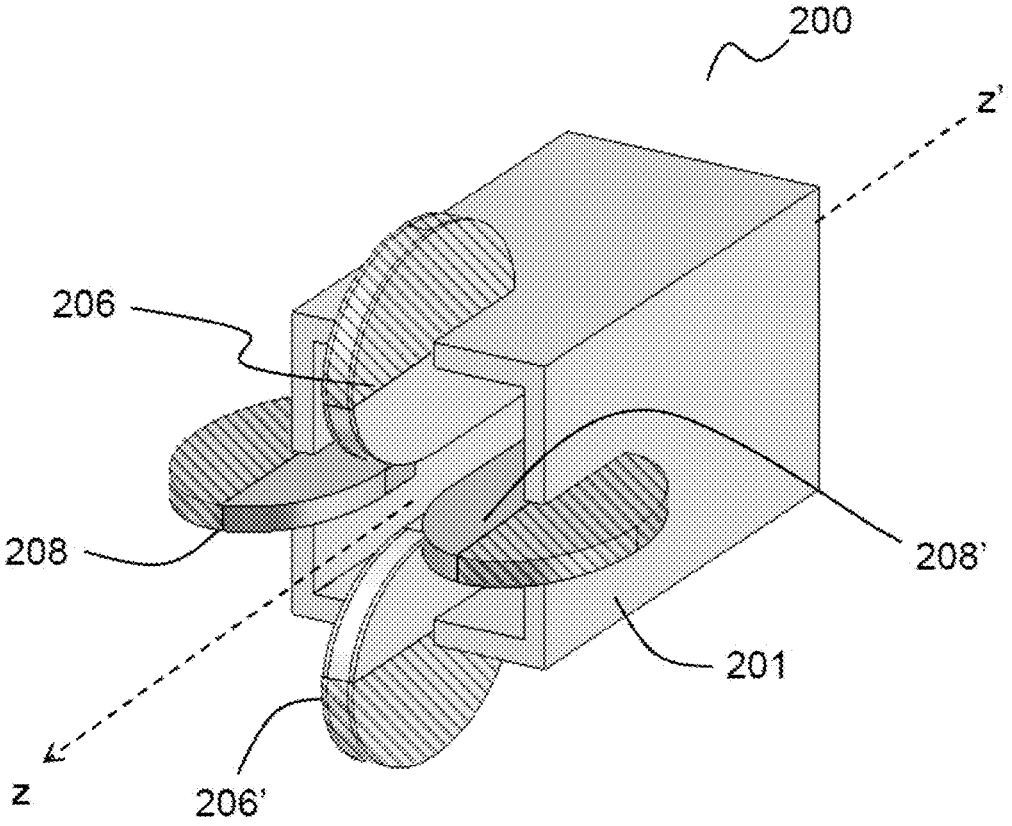
FIG. 2*b* shows the antenna horn from FIG. 2*a* in a three-quarter front view.

FIG. 2*b* shows the antenna horn from FIG. 2*a* in a three-quarter front view, that is to say from side of the opening of the waveguide 201. It depicts the ridges 206 and 206', which in fact extend all along the walls 204 and 204' of the waveguide along the longitudinal axis. It can also be seen that the central wall ends in the form of two ridges 208 and 208' that form a protuberance in the middle of each of the walls of the second pair of walls 205 and 205' at the level of the open end of the waveguide. The two ridges 208 and 208' are of identical width and height.

In this embodiment the ridges 206, 206', 208 and 208' extend outside the waveguide 201, where they take on a flared shape so as to perform the matching between guided propagation inside the waveguide 201 and propagation in free space. An elliptical shape is used in the illustrations, but any shape allowing a progressive change of dimensions to be produced between the inside and the outside of the horn is suitable. In particular a stepped progressive flaring can allow fine matching in the two frequency bands.

In the example in FIG. 2*b*, the ridges form a semicircle and overlap on the outside of the waveguide 201. This manifestation is advantageous for the networking of antenna horns, but the shaded part of the ridges is not essential for implementing an elementary horn according to the invention.

Figure 2C:
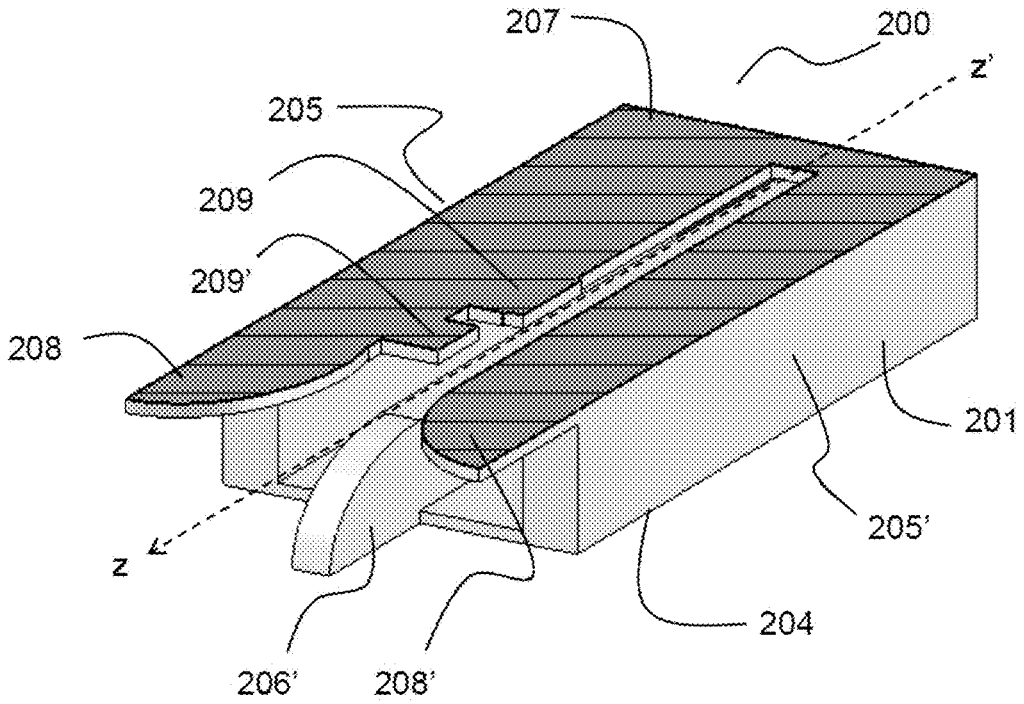
FIG. 2*c* shows the antenna horn from FIGS. 2*a* and 2*b* in a three-quarter front sectional view along a vertical plane situated in the middle of the horn.

FIG. 2*c* shows the antenna horn from FIGS. 2*a* and 2*b* in a three-quarter front sectional view along a vertical plane situated in the middle of the horn. It depicts the waveguide 201 and the ridge 206'. At the back of the antenna horn, at the end used to access the signals, the central wall 207 connects the two walls 205 and 205' of the waveguide in continuous fashion at their midpoints. At the front of the antenna horn, at the open end through which the horn radiates, the central wall forms the two ridges 208 and 208'. Between the two, the central wall is interrupted in the direction of the open part of the waveguide 201, so as to form a septum polarizer allowing the signals transmitted in the two accesses 202 and 203 to be polarized in orthogonal circular polarizations. In particular, the polarization function is performed by designing the central wall so that it transfers part of the energy from the vertical mode to the horizontal mode while applying a delay equal to $\lambda_g/4$ between these two modes, where $\lambda_g$ is the guided wavelength of the frequency band of interest taking into account the presence of the ridges. Such a result can be obtained by using a central wall, interrupted at its centre, that has a plurality of teeth, such as the teeth 209 and 209' in FIG. 2*c*.

The dimensions of the waveguide 201 are chosen so that it is adapted for the propagation of electromagnetic waves according to the modes of propagation TE10 and TE01 in the frequency band of interest at the level of its open end, specifically in reduced dimensions on account of the ridges arranged on each of its walls. Thus, the first ridges 206 and 206' positioned against the first pair of walls of the waveguide and the second ridges 208 and 208' positioned against the second pair of walls of the waveguide are not necessarily of identical height and width, the first ridges being sized on the basis of the width a of the walls 204 and 204' for the mode of propagation TE10, the second ridges being sized on the basis of the width of the walls 205 and 205', which is equal to 2*b* plus the height of the central wall 207, for the mode of propagation TE01. The height of the central wall 207 is therefore linked to the width of the ridges allowing propagation according to the TE01 mode in the waveguide 201.

The central wall therefore plays a triple role: it allows the accesses 202 and 203 to be delimited, the circular polarization function to be performed by forming a quarter-wave septum, and the propagation of circularly polarized waves in a waveguide of reduced dimensions to be made possible on account of its ends 208 and 208'.

Figure 2D:
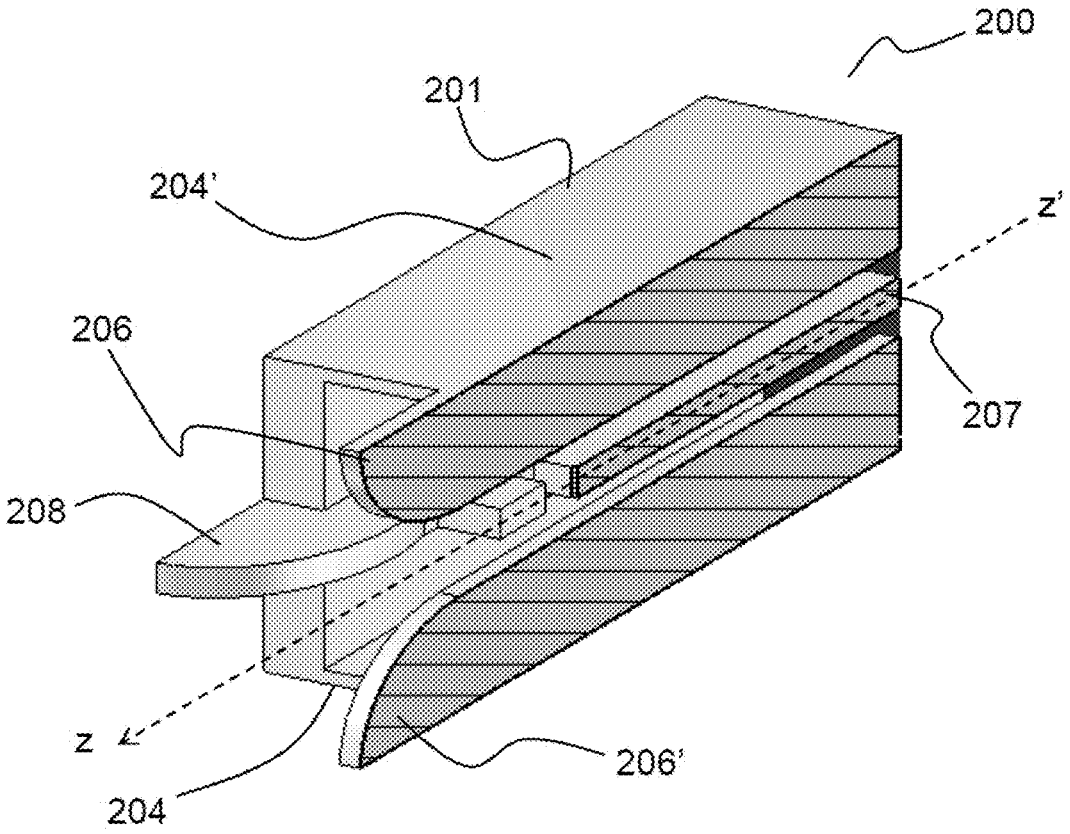
FIG. 2*d* shows the antenna horn from FIGS. 2*a* and 2*b* in a three-quarter front sectional view along a horizontal plane situated in the middle of the horn.

FIG. 2*d* shows the antenna horn from FIGS. 2*a* and 2*b* in a three-quarter front sectional view along a horizontal plane situated in the middle of the horn. It can be seen in particular that the ridges 206 and 206' form protuberances positioned along and in the middle of opposite walls 204 and 204' of the waveguide 201.

According to one embodiment of the invention, the waveguide 201 is of square section. In this case, the walls to which the ridges 206 and 206' are attached can be chosen to be the opposite horizontal walls 204 and 204' or the opposite vertical walls 205 and 205' equally. In the second case, this entails the central wall 207 extending vertically along the longitudinal axis zz', so as to connect the middles of the walls 204 and 204' at the level of the accesses.

By choosing the waveguide 201 to be of square section, the ridges 206 and 206' of the horizontal walls and the ridges 208 and 208' of the vertical walls can have the same heights and widths. In this case, the ellipticity rate of the transmitted signals is optimum and the circular polarization is very pure.

The waveguide 201 can be chosen to have a non-square rectangular section so as for example to have standard-format accesses 202 and 203 with a ratio a/b equal to ½, or for a mesh of restricted size so as to meet requirements concerning the maximum scanning angle and the maximum operating frequency.

The waveguide according to the invention allows transmission and reception to be performed simultaneously, for example in the Ka band for satellite communications, using a single antenna horn of reduced dimensions, thus satisfying a need to reduce the mesh pitch of networks of horns in scanning antennas. It has numerous advantages compared with the prior art:

- it is very compact, due to the use of ridged waveguides,
- it comprises no dielectric elements, which makes it simple to assemble, inexpensive to manufacture, and allows it to have homogeneous performance over time and during temperature variations;
- it has no losses linked to the use of dielectric materials, which allows a maximum antenna gain to be obtained;
- the dimensions of the antenna horn or of the operating frequency band are very easily adjustable since they are linked to the size of the ridges situated in the waveguide. It is therefore compatible with the continual need to increase the operating frequency;
- it can be integrated into a mesh of smaller size than the antenna horns of the prior art, in particular a mesh having a pitch size less than $\lambda/2$, and therefore allows wider-angle scanning antennas to be manufactured;
- it is totally metal and can be manufactured by machining or by additive manufacture (3D printing). The latter method of manufacture allows antenna horns or networks of horns to be produced rapidly and inexpensively, using simple three-dimensional modelling;
- the ends of the ridges 206, 206', 208 and 208' situated outside the waveguide 201 allow certain adverse effects to be prevented during heightened scanning: a drop in gain (scan loss), blind spot (loss of the beam), depolarization (effects usually promoted by the presence of a dielectric).

Figure 3:
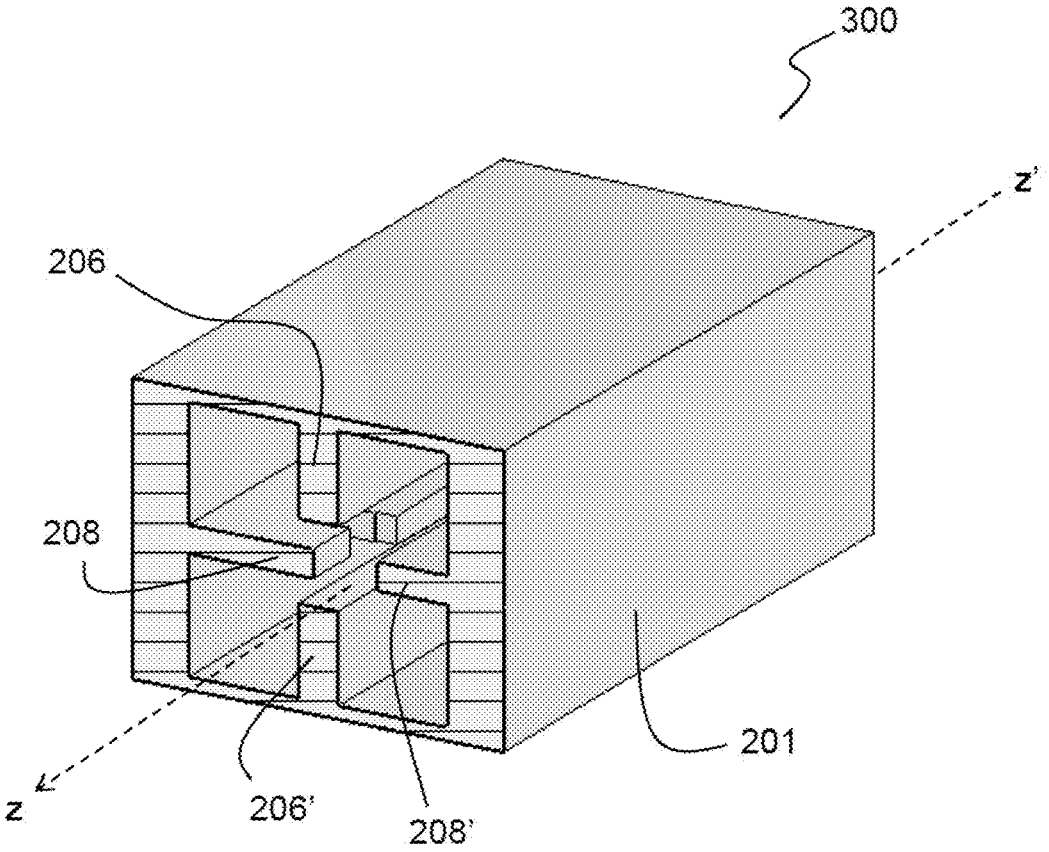
FIG. 3 shows another embodiment of an antenna horn according to the invention, in a three-quarter front view.

FIG. 3 shows another embodiment of an antenna horn according to the invention, in three-quarter front view. This embodiment differs from the one shown in FIGS. 2*a* to 2*d* in that the ridges 206, 206', 208 and 208' do not extend outside the waveguide 201. In this embodiment, a dielectric layer such as the layer 115 needs to be added to the open end of the antenna horn 300 in order to perform the matching between guided propagation inside the horn and propagation in free space.

This embodiment has the defect of requiring a layer of dielectric material to be assembled with the metal part of the horn. However, the layer of dielectric 115 is deposited over the opening of the waveguide 201. It is then simple to assemble and can be adjusted in one piece for all of the horns of a network of horn antennas according to the invention, thus limiting the costs of manufacture.

Figure 4:
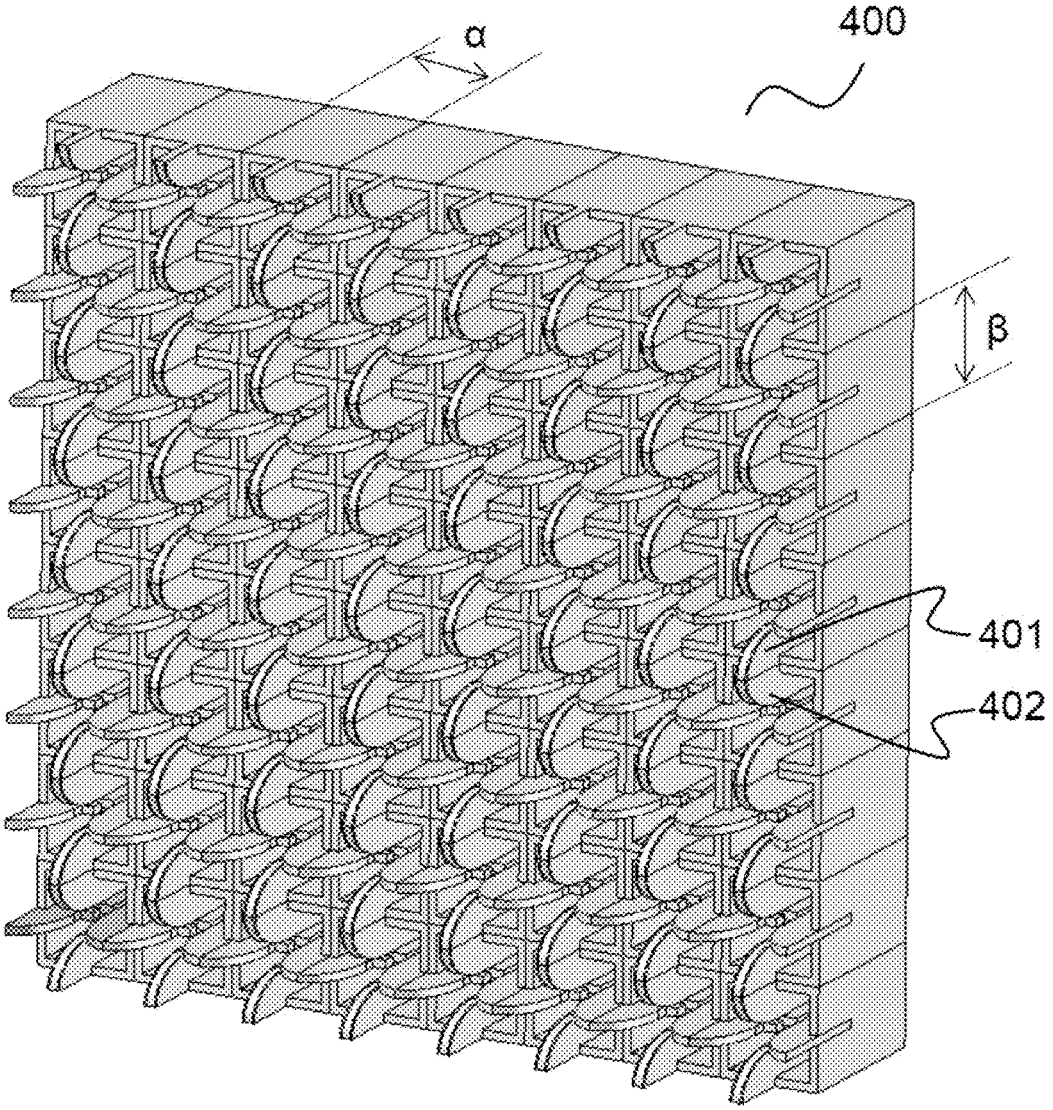
FIG. 4 shows a network of antenna horns according to an embodiment of the invention.

FIG. 4 shows a network of antenna horns according to an embodiment of the invention, implementing elementary antenna horns such as the one described in FIGS. 2*a* to 2*d*.

The network 400 has a mesh of pitch $\alpha$ along one dimension and of pitch $\beta$ along the other dimension, corresponding exactly to the outer dimensions of the waveguide 201. Each antenna horn then totally fits the space assigned to it, which is optimal in regard to occupation.

In the embodiment in FIG. 4, the adjacent ridges of adjacent horns, such as the ridges 401 and 402, are connected so as to form just a single continuous ridge. The absence of discontinuities allows, among other things, a reduction in the radar cross section (RCS) of the network antenna.

The invention is therefore concerned with a compact antenna horn that can be integrated into a network of elementary antennas. The horn is described in relation to the instance of application represented by satellite communications in the Ka band, but could be used for any type of communications in a given frequency band involving the transmission of two circularly polarized signals.

The invention is also concerned with an item of radio communication equipment comprising an antenna horn or a network of antenna horns according to the invention. The radio communication equipment may be installed on a terrestrial or aerial vehicle, for example.

Finally, the invention is concerned with a telecommunication method, in particular a satellite telecommunication method, between two items of radio communication equipment according to the invention. The method comprises the transmission and/or reception of signals using an antenna horn or a network of antenna horns according to the invention.

The invention claimed is:

1. An antenna horn, comprising:

a waveguide extending along a longitudinal axis, the waveguide having an open end and an end allowing access to signals transmitted in the waveguide, the widest opposite walls of the waveguide constituting a first pair of walls of the waveguide and the other two walls of the waveguide constituting a second pair of walls of the waveguide, the antenna horn comprising:

two first ridges extending along the longitudinal axis inside the waveguide, in the middle and over the whole length of each of the walls of the first pair of walls, a flat central wall extending in the waveguide along the longitudinal axis, the central wall being configured so as, at the end allowing access to the signals transmitted in the waveguide, to connect the two walls of the second pair of walls at their midpoints, thus forming two separate accesses to said signals, and at the open end of the waveguide to stop so as to polarize signals transmitted by the two accesses according to orthogonal circular polarizations, the central wall forming two second ridges extending along the longitudinal axis in the middle of each of the walls of the second pair of walls from the open end of the waveguide.

2. The antenna horn according to claim 1, wherein the waveguide has a square cross section, either two opposite walls of the waveguide constituting the first pair of walls and the other two opposite walls of the waveguide forming the second pair of walls.

3. The antenna horn according to claim 1, wherein the waveguide, the first pair of ridges and the second pair of ridges have dimensions adapted for the propagation of electromagnetic waves according to the modes of propagation TE10 and TE01 in the frequency band of the transmitted signals, and wherein the two accesses have dimensions adapted for the propagation of electromagnetic waves according to the mode of propagation TE10.

4. The antenna horn according to claim 1, moreover comprising a layer of dielectric material positioned so as to cover the open end of the waveguide and configured to perform the matching between propagation inside the waveguide and propagation in free space.

5. The antenna horn according to claim 1, wherein the first and second ridges extend outside the waveguide through its open end while having a flared shape outside the waveguide.

6. The antenna horn according to claim 1, wherein the two first ridges have identical heights and widths and wherein the two second ridges have identical heights and widths.

7. The antenna horn according to claim 1, wherein one of the accesses formed by the central wall and the waveguide is used to inject a first signal at a first frequency, and wherein the other access is used to extract a signal at a second frequency, which is different from the first frequency, the first frequency and the second frequency belonging to the Ka band of the electromagnetic spectrum.

8. The antenna horn according to claim 1, wherein the waveguide has a cross section with sides having a size less than $\lambda/2$, where $\lambda$ is the wavelength of the signals to be transmitted.

9. An antenna comprising at least one antenna horn according to claim 1.

10. An antenna comprising a network of at least two antenna horns according to claim 1, which are arranged in a mesh of regular pitch, wherein the first and second ridges extend outside the waveguides through their open ends while having a flared shape, the adjacent antenna horns being connected by the end of one of their ridges outside the waveguides.

11. A radio communication equipment comprising an antenna according to claim 9.

12. A telecommunication method, between two stations, the method comprising the use of an item of radio communication equipment according to claim 11.

* * * * *